US010005310B2

(12) United States Patent
Witter

(10) Patent No.: US 10,005,310 B2
(45) Date of Patent: Jun. 26, 2018

(54) POCKET WITH STRESS RELIEF

(75) Inventor: Kevin Witter, Centerville, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 513 days.

(21) Appl. No.: 12/020,909

(22) Filed: Jan. 28, 2008

(65) Prior Publication Data

US 2008/0179875 A1 Jul. 31, 2008

Related U.S. Application Data

(60) Provisional application No. 60/897,957, filed on Jan. 29, 2007.

(51) Int. Cl.

| | |
|---|---|
| ***B42D 3/00*** | (2006.01) |
| ***B42D 1/00*** | (2006.01) |
| ***B42D 5/00*** | (2006.01) |
| ***B42D 7/00*** | (2006.01) |
| ***B42F 21/00*** | (2006.01) |
| ***B42F 7/02*** | (2006.01) |
| ***B42F 7/06*** | (2006.01) |

(52) U.S. Cl.
CPC . *B42F 7/02* (2013.01); *B42F 7/06* (2013.01)

(58) Field of Classification Search
CPC ..... B42F 3/00; B65D 27/08
USPC ..... 206/215; 229/1.5 R, 72; 281/15.1, 21.1, 281/22, 29, 31, 37, 38, 45, 51; 353/120; 402/4, 70, 73, 79; 283/36, 37, 38, 42, 67, 283/70, 72, 81, 101, 114
See application file for complete search history.

(56) References Cited

U.S. PATENT DOCUMENTS

| | | | | |
|---|---|---|---|---|
| 5,806,894 | A | 9/1998 | Dottel | |
| 6,032,984 | A * | 3/2000 | Ishida | 283/70 |
| 6,079,614 | A | 6/2000 | Ho | |
| 6,168,340 | B1 | 1/2001 | Lehmann et al. | |
| 6,213,516 | B1 * | 4/2001 | Ong | 281/29 |
| 6,431,779 | B1 * | 8/2002 | Moor et al. | 402/73 |

(Continued)

FOREIGN PATENT DOCUMENTS

| | | |
|---|---|---|
| EP | 0554693 A1 | 8/1993 |
| NL | 7810440 | 4/1980 |

OTHER PUBLICATIONS

CA, Office Action, Canadian Patent Application No. 2,619,106, 2 pages (dated Oct. 1, 2009 ).

(Continued)

*Primary Examiner* — Justin V Lewis
(74) *Attorney, Agent, or Firm* — Thompson Hine LLP

(57) ABSTRACT

A pocket device for papers or the like includes a major panel and a pocket panel attached to the inner surface of the major panel to define a pocket between the major panel and the pocket panel. The pocket panel has a secured edge along which the pocket panel is attached to the major panel. The pocket panel also has a free edge along which the pocket panel is unattached to the major panel so that the free edge is moveable away from the major panel to allow one or more papers to be inserted into the pocket. The free edge of the pocket panel is disposed next to the secured edge and extends transversely of the secured edge. The pocket panel has a stress relief area for reducing and minimizing tearing of the pocket panel. The stress relief area located along the free edge proximate to the secured edge.

20 Claims, 4 Drawing Sheets

(56) References Cited

U.S. PATENT DOCUMENTS

| | | | | |
|---|---|---|---|---|
| 6,666,610 | B1 * | 12/2003 | Moor et al. | 402/79 |
| 2004/0066031 | A1 * | 4/2004 | Wong et al. | 281/31 |

OTHER PUBLICATIONS

CA, Office Action, Canadian Patent Application No. 2,619,106, 2 pages (dated Jul. 27, 2010).
CA, Office Action, Canadian Patent Application No. 2,619,106, 2 pages (dated Mar. 1, 2012).
CA, Notice of Allowance, Canadian Patent Application No. 2,619,106, 1 page (dated Dec. 24, 2012).

* cited by examiner

POCKET WITH STRESS RELIEF

CROSS-REFERENCE TO RELATED APPLICATION

This application claims the benefit of the filing date of U.S. Provisional Application Ser. No. 60/897,957, entitled "Pocket with Stress Relief" filed on Jan. 29, 2007, the entirety of which is incorporated herein by reference.

BACKGROUND

The present invention is directed to a pocket design, and more particularly, to a pocket design incorporating stress relief features.

Many consumer and office products, such as binders, notebooks, portfolios, planners, date books, insert pockets and the like are made of or include a pair of flat, opposed panels joined together at their outer edges to define a pocket therebetween. Such pockets may be prone to wear and tear over the course of time. More particularly, the outer edges of the pocket may be stressed and may tear. Accordingly, there is a need for a pocket design which can accommodate such stresses and avoid tearing thereof.

SUMMARY OF THE INVENTION

This disclosure in a first aspect provides a device for receiving and storing one or more objects such as papers or the like. The device comprises a major panel and a pocket panel attached to the inner surface of the major panel to define a pocket between the major panel and the pocket panel. The pocket panel includes a secured edge along which the pocket panel is attached to the major panel and a free edge along which the pocket panel is unattached to the major panel. The pocket panel is so attached that the free edge is moveable away from the major panel to allow one or more objects to be inserted into the pocket. The free edge is disposed next to the secured edge and extends transversely of the secured edge. The pocket panel comprises a stress relief area located along the free edge proximate to the secured edge.

In a preferred embodiment of the first aspect, the stress relief area may be located at an end of the free edge proximate to the secured edge.

In another embodiment, wherein the stress relief area may include an element selected from the group consisting of an opening, a recess and a cutout. The element may be formed in the pocket panel. In this embodiment, the element may extend from the free edge generally toward the secured edge. Alternatively, the element may be generally "z"-shaped and may comprise a pair of proximal and distal legs interconnected by a transverse portion. Each of the proximal and distal legs may extend generally perpendicular to the free edge while the transverse portion may extend generally parallel to the free edge and generally perpendicular to the legs. Alternatively, the transverse portion may define an acute angle with respect to the free edge. The pocket panel may further include a short attachment edge along which the pocket panel is secured to the major panel. Such a short attachment edge may extend from the secured edge toward the proximal leg of the element. The pocket panel may have a corner between the secured edge and the free edge while the device may include a securing member placed at the corner. The securing member may extend through the pocket panel and the major panel to securely couple them together. The element may be positioned proximate to the securing member.

The disclosure in a second aspect provides a pocket device for receiving and storing one or more paper-like objects. The pocket device comprises a first major panel and a first generally rectangular pocket panel attached to the major panel to define a first pocket between the major panel and the pocket panel. The pocket panel has a pair of first and second adjacent secured edges along which the pocket panel is attached to the major panel. The pocket panel also has at least one free edge along which the pocket panel is unattached to the major panel. The at least one free edge is disposed next to the first secured edge at a position spaced from and opposed to the second secured edge. The pocket panel comprises a first cutout disposed at a location along the at least one free edge proximate to the first secured edge.

In one embodiment of the second aspect, the cutout may extend from the at least one free edge generally toward the first secured edge.

In another embodiment, the at least one free edge may comprise a pair of first and second free edges. The first free edge may be disposed next to the first secured edge at a position spaced from and opposed to the second secured edge whereas the second free edge may be disposed at a position spaced from and opposed to the first secured edge. The second free edge may extend from the first free edge toward the second secured edge. The first cutout may be disposed at a location along the first free edge proximate to the first secured edge. In this embodiment, the first cutout may extend from the first free edge generally toward the first secured edge. The pocket panel may further comprise a second cutout disposed at a location along the second free edge proximate to the second secured edge. The second cutout may extend from the second free edge generally toward the second secured edge.

In another embodiment, the pocket panel may further include a third secured edge along which the pocket panel is attached to the major panel The third secured edge may be disposed at a position spaced from and opposed to the first secured edge. In this embodiment, the at least one free edge may comprise a single free edge disposed between the first and third secured edges at a position spaced from and opposed to the second secured edge. The first cutout may be disposed at a location along the single free edge proximate to the first secured edge. The first cutout may extend from the single free edge generally toward the first secured edge. The pocket panel may further comprise a second cutout disposed at a location along the single free edge proximate to the third secured edge. The second cutout may extend from the single free edge generally toward the third secured edge.

In a further embodiment, the pocket device may further comprise a second major panel pivotably connected to the first major panel. In this embodiment, the pocket device may further comprise a second generally rectangular pocket panel attached to the second major panel to define a second pocket between the second major panel and the second pocket panel.

The disclosure in a third aspect provides a folder for paper-like objects which comprises a pair of first and second major panels and a pocket panel. The first and second major panels are pivotably connected together such that either the first or second major panel is moveable between an opened position and a closed position. In the opened position, the first and second major panels lay generally flat in substantially the same plane whereas in the closed position, the first and second major panels are disposed in a generally parallel relationship. The pocket panel is attached to at least one of the first and second major panels to define a pocket between the pocket panel and the at least one major panel. The pocket panel includes a secured edge along which the pocket panel is attached to the at least one major panel and a free edge along which the pocket panel is unattached to the at least one major panel. The free edge is disposed next to the secured edge and extends transversely of the secured edge. The pocket panel comprises at least one cutout disposed at a location along the free edge proximate to the secured edge.

In one embodiment of the third aspect, the folder may further comprise a spine pivotably interconnecting the first and second major panels. In this embodiment, the folder may further comprise a binding mechanism mounted to one of the spine, the first major panel and the second major panel.

DETAILED DESCRIPTION

Figure 1:
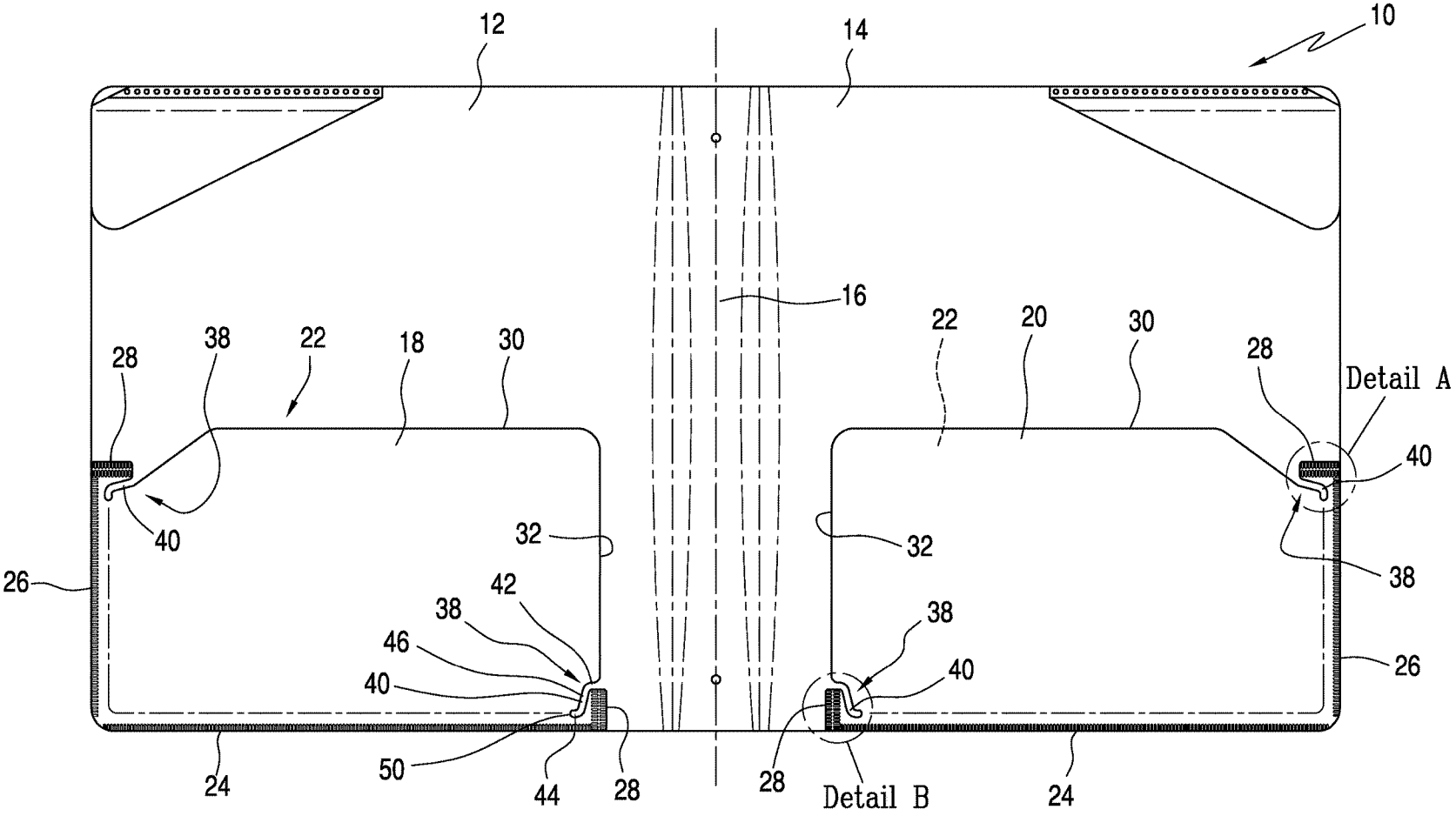
FIG. 1 is a top view of one embodiment of a binder in its open position utilizing a pocket design of the present invention.

As shown in FIG. 1, in one embodiment the present disclosure is a folder or binder 10 having a pair of opposed major panels 12, 14. Each major panel 12, 14 is attached to opposed sides of a spine 16 that is positioned between the major panels 12, 14. In this manner, each major panel 12, 14 is independently pivotable about the spine 16 such that the binder 10 is moveable between an open position (shown in FIG. 1) wherein the major panels 12, 14 lay generally flat and co-planar, and a closed position (not shown) wherein the major panels 12, 14 are generally parallel, aligned, and face each other. If desired, a binding mechanism (such as a three-ring binding mechanism) or the like may be mounted to the spine 16 or to one of the major panels 12, 14.

Generally rectangular pocket panels 18, 20 are attached to the inner surface of an associated major panel 12, 14 to define a pocket 22 therebetween. More particularly, each pocket panel 18, 20 may be securely coupled to the underlying major panel 12, 14 along two major outer edges 24, 26 thereof, for example by welding. Each pocket panel 18, 20 may be further secured to the associated major panel 12, 14 by a pair of short inwardly-extending attachment lines 28, for example by welding. Each pocket panel includes a pair of free edges 30, 32 that are not directly coupled to the associated major panel 12, 14. Each pocket 22 can be sized to receive the lower portions of eight and one half inch by eleven inch sized papers, or can be sized to receive various other-sized papers or components therein.

The major panels 12, 14, pocket panels 18, 20 and spine 16 can be made of any of a wide variety of materials, including but not limited to cardboard, paperboard, plastic (such as polypropylene or vinyl), plastic encased cardboard, etc. The pocket panels 18, 20 can be attached to the associated major panel 12, 14 by any of a wide variety of methods, such as heat welding, sonic welding, stitching, adhesives, staples, rivets or other mechanical fasteners, etc.

Figure 3:
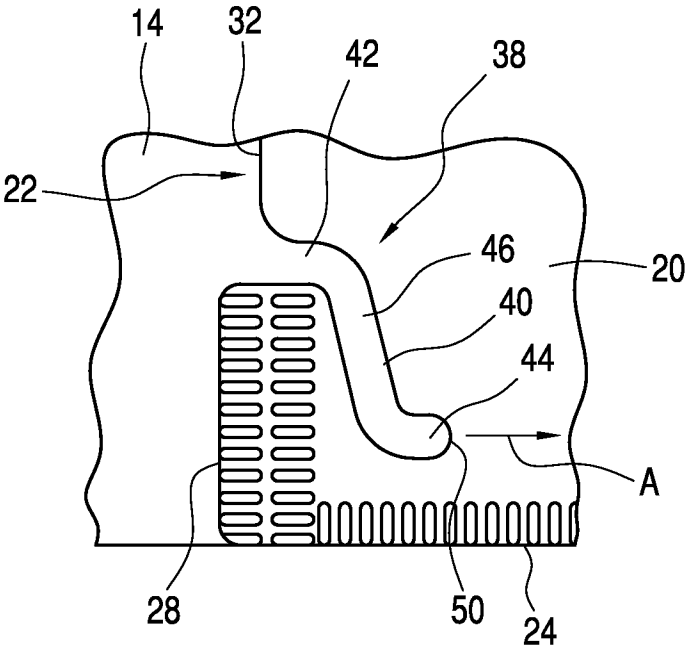
FIG. 3 is a top view of the area indicated Detail B in FIG. 1.
Figure 2:
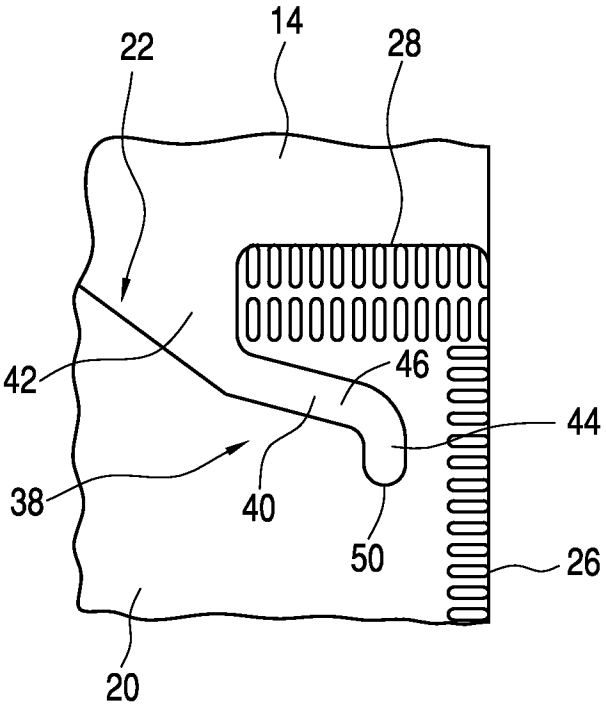
FIG. 2 is a top view of the area designated Detail A in FIG. 1.

Each free edge 30, 32 of each pocket panel 18, 20 is moveable away from the underlying major panel 12, 14 to allow any flat, paper-like objects such as papers, loose components or the like to be inserted into the pocket 22. As best shown in FIGS. 2 and 3, a stress relief feature, generally designated 38, may be located at the outer edge of each free edge 30, 32 (i.e. at or proximate to a location where a free edge 30, 32 and a secured edge 24, 26, 28 intersect). The stress relief feature 38 can be an opening, recess or cut-out (hereinafter collectively termed an opening 40) in the pocket panel 18, 20. In the illustrated embodiment, the opening 40 is generally zigzag or "z"-shaped having a pair of relatively short legs 42, 44 (a proximal leg 42 and a distal leg 44) connected by a longer transverse portion 46.

In the illustrated embodiment, each leg 42, 44 extends generally or at least partially perpendicular to the adjacent free edge 30, 32, and the transverse portion 46 extends generally or at least partially parallel to the free edge 30, 32 and generally perpendicular to the legs 42, 44. In addition, in the illustrated embodiment, the transverse portion forms an acute angle (in one case between about 0 and about 30 degrees) relative to the free edge 30, 32. The distal leg 44 terminates at a terminal point 50. Each leg 42, 44 may have length that is about equal to or less than the length of the associated transverse portion 46. The transverse portion 46 is positioned between the legs 42, 44, or between the distal leg 44 and the adjacent free edge 30, 32 of the pocket 22.

An opening 40 can be located at each position of each pocket 22 where a free edge 30, 32 and a secured edge 24, 26, 28 intersect. The openings 40 help to reduce stress and tearing of the pocket 22 when the pocket panel 18, 20 is pulled away from the underlying major panel 12, 14. More particularly, when the pocket panel is pulled away any stresses are guided to the terminal tip 50 of the opening 40. In addition, the applied stresses are applied in the direction of the arrow A of FIG. 3. It can be seen that there is a relatively large amount of material of the pocket panel 20 about the terminal point 50 to help accommodate the stresses at the terminal point 50. In addition, because the stress A is directed generally perpendicular to the associated free edge 32, and generally parallel to the adjacent secured edge 24, it can be seen that any tear in the pocket panel 20 can travel for a significant distance in the direction of arrow A before the tear would reach any outer edges 24, 26, 28, 30, 32 of the pocket panel.

Thus, it can be seen that the proximal leg 42 of the opening 40 of FIG. 3 guides any applied stresses inwardly away from the free edge 32, the transverse portion 46 guides the stresses further inwardly away from the free edge 32 and away from the proximal leg 42. Finally, the distal leg 44 guides the stresses even further away from the free edge 32 and in a direction generally perpendicular to the free edge 32.

The changes of directions, corners and terminal point 50 of the opening 40 may be curved (i.e. having a radius of at least about 0.06 inches) to avoid the presence of sharp corners which can concentrate stresses. The opening 40 may have a generally uniform width (i.e. between about 0.05 and about 0.2 inches) and may have a total length that is between about one and about ten times as long as its width. The opening 40 may extend a total distance that is less than about 1/10 of the perimeter of the pocket 22. In one embodiment the proximal leg 42 of the opening 40 can terminate in a relatively wide mouth, as shown in FIG. 2.

Thus, the stress relief feature 38 allows the pocket panels 18, 20 to be pulled away from the major panel 12, 14 while reducing and minimizing tearing, and also reducing any adverse effects should any tearing occur. This provides a more durable tear-resistant pocket 22. Furthermore, the stress relief feature 38 can allow the pocket panels 18, 20 to be made of thinner and/or cheaper materials while still resisting tearing to thereby reduce the overall cost of the pocket 22.

Figure 4:
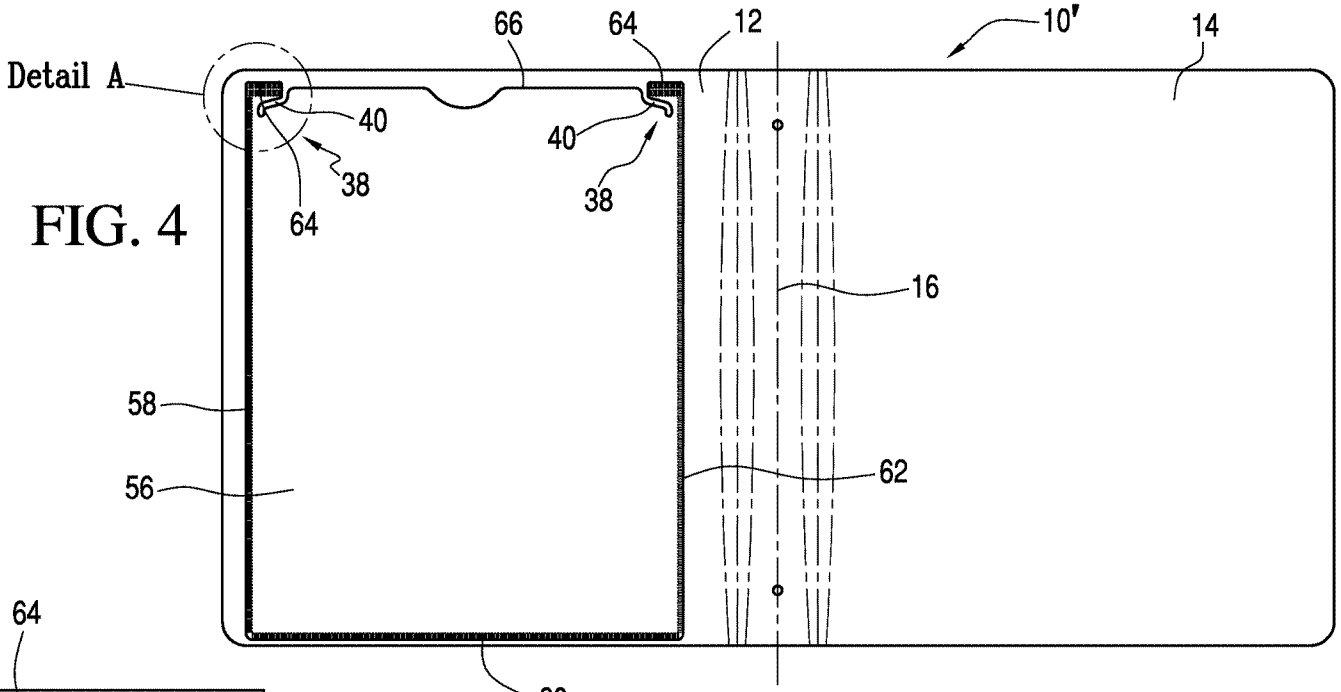
FIG. 4 is a top view of a binder in its open position utilizing another pocket design.
Figure 5:
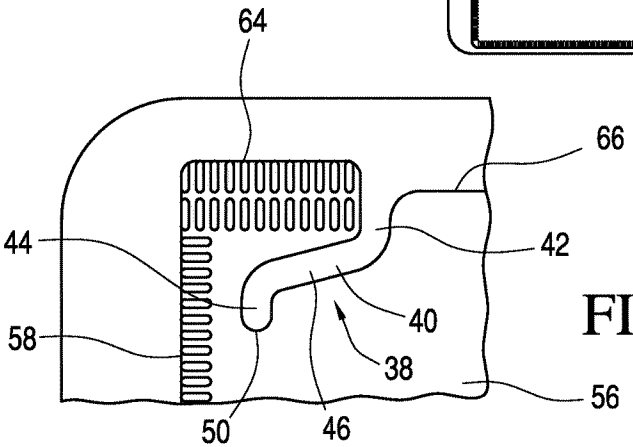
FIG. 5 is a top view of the area designated Detail A in FIG. 4.

FIGS. 4 and 5 show another binder 10 with a relatively large pocket panel 56 attached to the underlying major panel 12 about three edges 58, 60, 62, for example, by welding and along two short attachment lines 64, for example, by welding. The pocket panel 56 is unattached along its free edge 66. A pair of stress relief features 38/openings 40 having features similar to the stress relief features 38/openings 40 described above are provided at the outer tips of the free edge 66 of the pocket panel 56.

Figure 6:
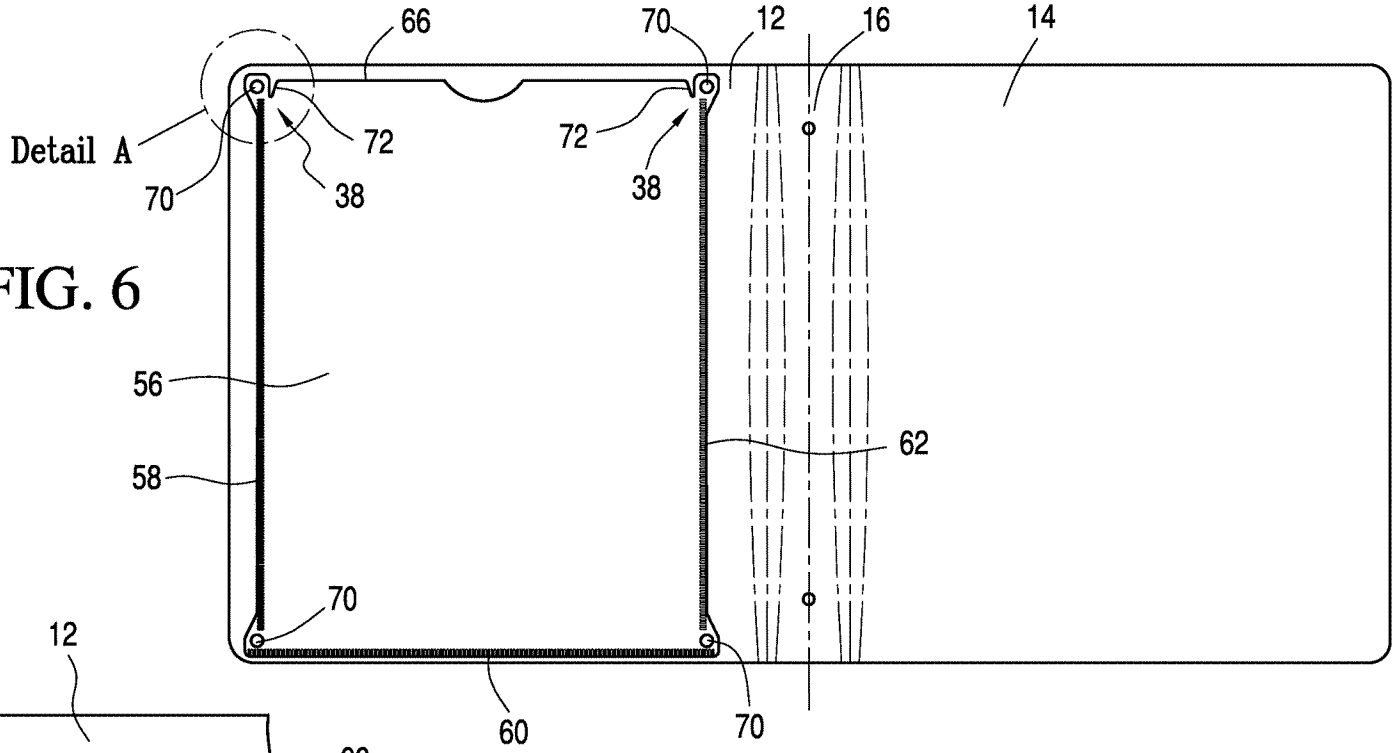
FIG. 6 is a top view of a binder in its open position utilizing another pocket design.
Figure 7:
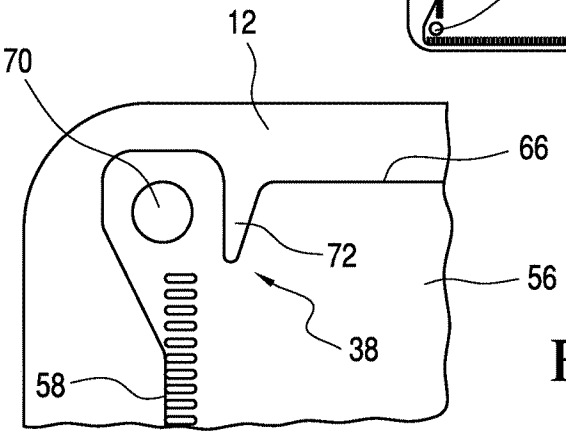
FIG. 7 is a top view of the area indicated Detail A in FIG. 6.

In the embodiment of FIGS. 6 and 7, the pocket panel 56 is coupled to the underlying major panel 12 about three secured edges 58, 60, 62, and the pocket panel 56 includes a free upper edge 66. In addition, a rivet 70 is located at each corner of the pocket panel 56, and extends through the pocket panel 56 and major panel 12 to securely couple the pocket panel 56 and major panel 12 together. The rivets 70 provide an extremely strong connection, but the location of the rivets 70 also provides a position of high stresses when the pocket panel 56 is pulled away from the major panel 12. A stress relief feature 38, in the form of an opening, recess or cut-out (hereinafter collectively termed an opening 72), can be positioned between each rivet 70 and the adjacent free edge 66. In the embodiment illustrated in FIGS. 6 and 7, the opening 72 is a generally "v" or "u"-shaped notch.

When the pocket panel 56 is pulled away from the major panel 12, the openings 72 allow the free edge 66 to be pulled further away from the underlying panel 12 before large stresses, which can cause tearing in the pocket panel 56, are induced in the pocket panel 56. Thus the openings 72 provide a greater range of motion and direct stresses away from the rivets 70. The tip of each opening 72 may be curved, and may have a radius of at least, for example, about 0.05 inches, or at least about 0.1 inches, or at least about 0.5 inches, to help avoid or minimize tearing.

The pocket design of the present invention can be used in nearly any pocket used alone or in pockets used in conjunction with or integrated into other school or office items, such as binders, notebooks, portfolios, planners, date books, insert pockets and the like. Further it should be noted that the various materials and dimensions shown in the attached drawing are illustrative of only a few embodiments of the invention, and the invention is not limited to such materials and dimensions.

Having described the invention in detail and by reference to the various embodiments, it should be understood that modifications and variations thereof are possible without departing from the scope of the invention.

In one embodiment, the present invention is a pocket structure including first and second generally flat, planar panels. The first panel is coupled to the second panel at least partially along at least one secured edge, and is not coupled to the second panel at least partially along at least one free edge, to define a pocket therebetween. The first panel has an opening positioned at or proximate to an intersection of the secured edge and the free edge. The opening includes a transverse portion extending generally parallel to the free edge, and a leg portion extending generally perpendicular to the free edge, wherein the transverse portion is positioned between the leg and the free edge.

What is claimed is:

1. A device for receiving and storing one or more objects, comprising:

a major panel;

a pocket panel attached to a surface of the major panel to define a pocket between the major panel and the pocket panel, the pocket panel comprising:

a secured edge along which the pocket panel is attached to the major panel;

a free edge along which the pocket panel is unattached to the major panel so that the free edge is moveable away from the major panel to allow one or more objects to be inserted into the pocket, the free edge being disposed next to the secured edge and extending transversely of the secured edge; and a stress relief area located along the free edge proximate to the secured edge, the stress relief area comprising a generally "z"-shaped element selected from the group consisting of an opening or a cutout, the element being formed in the pocket panel, the element including at least a first, second, and third portion, the first portion being located adjacent the free edge, the second portion extending between the first and third portions at an acute angle relative to the free edge, and the third portion being generally or at least partially parallel to the secured edge, each of the first and third portions having a length equal to or less than the length of the second portion, the first portion being a proximal leg, the third portion being a distal leg, the interconnecting second portion being a transverse portion, and wherein the configuration of the stress relief area directs stress generally perpendicular to the associated free edge and generally parallel to the secured edge.

2. The device of claim 1, wherein the element extends from the free edge generally toward the secured edge.

3. The device of claim 1, wherein each of the proximal and distal legs has a length that is no greater than the length of the transverse portion.

4. The device of claim 1, wherein the distal leg terminates at a rounded terminal point to avoid stresses concentration.

5. The device of claim 1, wherein the proximal leg of the element terminates in a wide mouth opening to the free edge, the wide mouth having a width wider than the width of the remainder of the element.

6. The device of claim 1, wherein the pocket panel further includes a short attachment edge along which the pocket panel is secured to the major panel, the short attachment edge extending from the secured edge toward the proximal leg of the element.

7. A pocket device for receiving and storing one or more paper-like objects, comprising:

a first major panel; and a first generally rectangular pocket panel attached to the major panel to define a first pocket between the major panel and the pocket panel, the pocket panel comprising a pair of first and second adjacent secured edges along which the pocket panel is attached to the major panel;

at least one free edge along which the pocket panel is unattached to the major panel, a first free edge being disposed next to the first secured edge at a position spaced from and opposed to the second secured edge; and a first cutout disposed at a location along the first free edge proximate to the first secured edge, the first cutout including at least a first, second, and third portion, the first portion being located adjacent the first free edge, the second portion extending between the first and third portions at an acute angle relative to the first free edge, and the third portion being generally or at least partially parallel to the first secured edge, each of the first and third portions having a length equal to or less than the length of the second portion and wherein the cutout directs stress generally perpendicular to the associated free edge and generally parallel to the secured edge and wherein the cutout is generally "z"-shaped, the first portion being a proximal leg, the third portion being a distal leg, the interconnecting second portion being a transverse portion.

8. The pocket device of claim 7, wherein the first cutout extends from the first free edge generally toward the first secured edge.

9. The pocket device of claim 7, wherein the at least one free edge further comprises a second free edge, the second free edge being disposed at a position spaced from and opposed to the first secured edge and extending from the first free edge toward the second secured edge.

10. The pocket device of claim 9, wherein the pocket panel further comprises a second cutout disposed at a location along the second free edge proximate to the second secured edge.

11. The pocket device of claim 7, wherein the pocket panel further includes a third secured edge along which the pocket panel is attached to the major panel, the third secured edge being disposed at a position spaced from and opposed to the first secured edge, wherein the at least one free edge comprises a single free edge disposed between the first and third secured edges at a position spaced from and opposed to the second secured edge, wherein the first free edge constitutes the single free edge, and wherein the first cutout is disposed at a location along the single free edge proximate to the first secured edge.

12. The pocket device of claim 11, wherein the pocket panel further comprises a second cutout disposed at a location along the single free edge proximate to the third secured edge.

13. The pocket device of claim 7, further comprising a second major panel pivotably connected to the first major panel.

14. The pocket device of claim 13, further comprising a second generally rectangular pocket panel attached to the second major panel to define a second pocket between the second major panel and the second pocket panel.

15. The pocket device of claim 13, wherein a folder is defined thereby.

16. The device of claim 1, wherein said stress relief area is formed entirely in said pocket panel.

17. The device of claim 1, wherein no part of said stress relief area is formed in said major panel.

18. The device of claim 1, wherein the inwardly-extending attachment line is formed by welding, stitching, adhesives, staples, or rivets, or other mechanical fasteners.

19. The device of claim 1, wherein a portion of the pocket panel is secured to the associated major panel by an inwardly-extending attachment line, the attachment line located between said stress relief area and said secured edge.

20. The pocket device of claim 7, wherein a portion of the pocket panel is secured to the associated major panel by an inwardly-extending attachment line, the attachment line located between said first cutout and said first secured edge.

* * * * *